US005647295A

United States Patent [19]

Korsgaard

[11] Patent Number: 5,647,295

[45] Date of Patent: Jul. 15, 1997

[54] APPARATUS FOR MOORING A VESSEL TO A SUBMERGED MOORING ELEMENT

[76] Inventor: Jens Korsgaard, 318 N. Post Rd., Princeton Junction, N.J. 08550

[21] Appl. No.: 533,127

[22] Filed: Sep. 25, 1995

[51] Int. Cl.[6] ..... B63B 21/00

[52] U.S. Cl. ..... 114/230; 441/3

[58] Field of Search ..... 114/230, 293; 441/3–5; 166/352–355; 405/203, 204, 224

[56] References Cited

U.S. PATENT DOCUMENTS

| | | | |
|---|---|---|---|
| 3,472,293 | 10/1969 | Bily | 114/230 |
| 3,664,388 | 5/1972 | Frankel | 441/4 |
| 4,086,865 | 5/1978 | Statham | 114/230 |
| 4,695,201 | 9/1987 | Beskow et al. | 405/204 |

FOREIGN PATENT DOCUMENTS

| | | | |
|---|---|---|---|
| 180394 | 10/1983 | Japan | 114/230 |

*Primary Examiner*—Edwin L. Swinehart
*Attorney, Agent, or Firm*—Kenyon & Kenyon

[57] ABSTRACT

A system for mooring oil transport, production, and drilling vessels in sea ice in the Arctic. The mooring system combines a submerged buoyant element structurally connected, for vertical movement, to an anchor structure on the seabed, and is designed to anchor a vessel equipped with a mooring system including a device for evacuating seawater from the mooring area between the hull of the vessel and the mooring element. The system can also be used without a vertically slidable mooring element, so that the vessel is directly fixed to the anchor structure using the device for evacuating seawater.

14 Claims, 6 Drawing Sheets

APPARATUS FOR MOORING A VESSEL TO A SUBMERGED MOORING ELEMENT

BACKGROUND OF THE INVENTION

1. Field of the Invention

The present invention relates generally to the mooring of oil transport, production, and drilling vessels in sea ice in the Arctic. More particularly the invention relates to a mooring system which combines a submerged buoyant element structurally connected to an anchor structure on the seabed, and designed to anchor a vessel equipped with a mooring system of the type described in U.S. Pat. Nos. 5,305,703 and 5,477,114.

2. Discussion of the Prior Art

Currently, moorings for vessels in sea ice do not exist. However, a number of proposals have been advanced, using single point moorings of the tower type in which the vessel moors by a structural connection at the deck level of the vessel to a pivoting structure mounted on top of a fixed tower protruding up through the ice. Very large forces need to be transferred in such a device, on the order of 50 to 100 MN. Forces of this magnitude exceed by a large factor the breaking strength of the largest commercially available chain or rope, therefore specially designed very large structural connectors are required.

An alternative means of station keeping that has been proposed is to use high powered, dynamically positioned icebreaking vessels assisted by nuclear or conventionally powered ice breakers. This technology may be feasible for oil shuttle tankers that can tolerate being forced off the mooring, by discontinuing the oil transfer until it can return to the loading point. Such force-offs are, however, much less acceptable for oil production or drilling vessels because in oil shuttle tankers the crude oil can be continually produced into a buffer storage while the shuttle tanker is unavailable, whereas forcing a production vessel off-station causes oil production shut-in, and forcing a drilling vessel off-station with insufficient warning may have catastrophic consequences.

SUMMARY OF THE INVENTION

An object of the present invention is to provide an improved mooring system of the single-point mooring type, permitting the rapid and secure mooring of ships in ice-infested waters.

Another objective is to provide a mooring capable of transmitting forces as large as 500 MN between the vessel and the sea bed.

Still another object is to provide a mooring that permits the vessel to weather vane in response to the change of direction of the drifting ice.

The above and other objects are met by providing a submerged mooring element that is engageable to the mooring area of a vessel equipped with an apparatus to reduce the hydrostatic pressure in the mooring area such as is described in U.S. Pat. Nos. 5,305,703 and 5,477,114.

An anchor structure on the sea bed in structural contact with the submerged mooring element is slidably engaged so that horizontal motions are resisted but vertical motion and rotation in the horizontal plane is permitted.

The upper part of the buoyant mooring element preferably includes at least one resilient annular member concentric with the vertical axis of the mooring element, the resilient annular member making initial contact with the mooring recess to cushion any impact between the mooring element and the vessel. Preferably the resilient annular member makes a circle of sealing contact with the bottom of the hull so that the device for rapidly drawing seawater away from the mooring area can pump out the region between the bottom of the hull and the upper part of the mooring element inside the circle of sealing contact. The upper part of the mooring element, or the lower part of the hull of the vessel, can include two concentric resilient annular members that makes circles of sealing contact at locations that are respectively radially inside and radially outside the location of the intake of the device for drawing away seawater, so that the downward pressure on the upper part of the mooring element between the concentric circles of sealing contact can be reduced to a level possibly as low as the vapor pressure of the seawater.

It is noted that vessels that are ice bound are not subjected to dynamic forces from wave action, therefore, very little flexibility or energy absorbing capacity is needed in a mooring. Normally such flexibility is provided in a mooring by catenary anchor chains, flexible ropes, or a combination thereof such as for example described in U.S. Pat. No. 5,305,703. However, ice bound vessels are subjected to extreme forces from the drifting ice. Only if the vessel is moored with a mooring capable of supplying the force required to break the drifting ice can the vessel remain moored.

The present invention pertains in particular to the mooring of vessels equipped to moor to a buoy held by hydrostatic pressure differentials such as described in U.S. Pat. Nos. 5,305,703 and 5,477,114. The buoys described in the two referenced U.S. patents are normally circular and in the description below it is assumed that the buoys are circular in a top view. However, it is not required that the buoys be circular and even larger forces could be obtained from a non-circular buoy. As an example of the capabilities of this invention, consider the mooring of a 250,000 DWT vessel with the following main dimensions: length between perpendiculars: 350 m, draft: 22 m, and breadth: 55 m. This vessel can accommodate a circular buoy 50 m in diameter. Such a buoy has a surface area of 2000 $m^2$. The fully loaded vessel has an absolute hydrostatic pressure at the keel of 320 kPa. Assume that the pressure above the buoy is lowered to 50 kPa, for example by pumps aboard the vessel withdrawing water from the volume isolated from the sea by the buoy and the vessel. The attractive force between the buoy and the vessel would be 540 MN. Assuming a friction coefficient of 0.5 between the buoy and the vessel, this results in the buoy being able to transmit a horizontal force of 270 MN to the vessel. Typical forces that a vessel must resist in the ice are in the range of 30 to 150 MN—however, they can be higher. In the event that the mooring force exceeds the capacity of this mooring, the mooring buoy is simply forced off the vessel by sliding along the bottom of the vessel. In contrast vessels that are moored with mechanical links must incorporate release mechanisms that release the mooring when the allowable load is exceeded. For the loads in question such devices must be very large.

DETAILED DESCRIPTION OF THE PREFERRED EMBODIMENT

Figure 1:
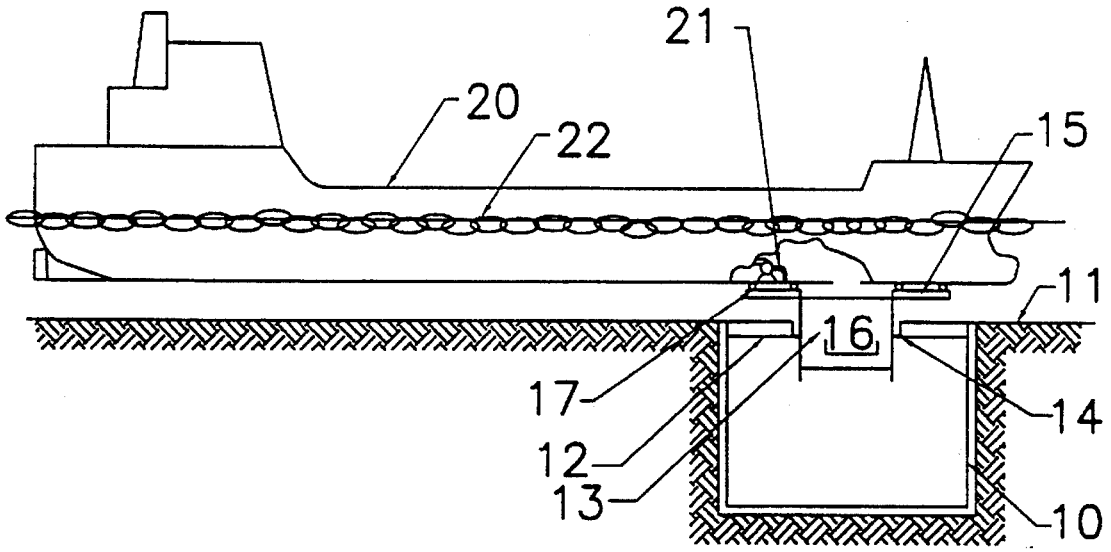
FIG. 1 shows a side view of a first embodiment of the present invention.
Figure 1A:
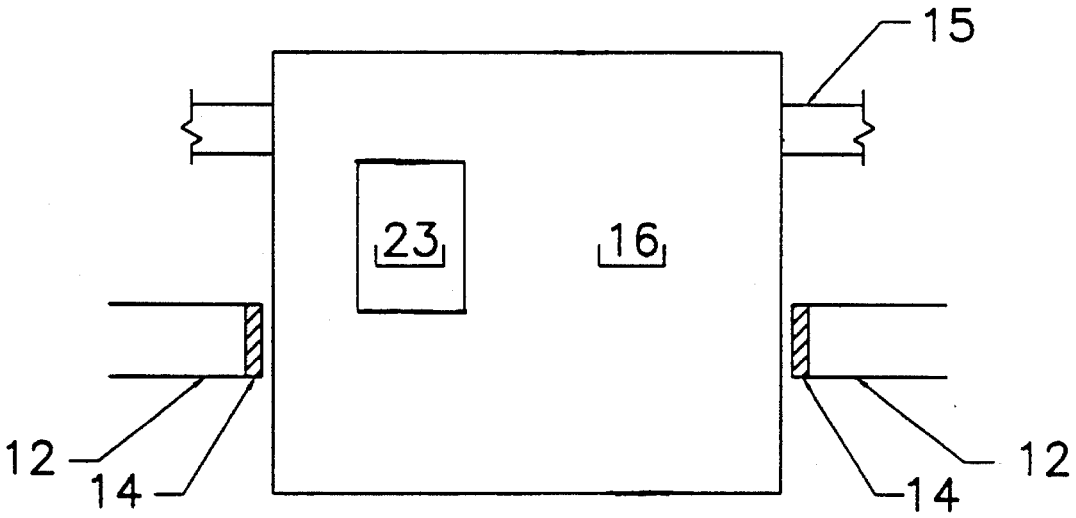
FIG. 1*a* shows a detail view of the buoyancy chamber of the embodiment of FIG. 1.

A preferred embodiment of the present invention is shown in FIG. 1. FIG. 1 shows a situation in which the sea is shallow at the point of mooring—only slightly deeper than the draft of the vessel. The anchor structure is a circular caisson 10 of size sufficient to resist the mooring forces. The caisson 10 is sunk into the sea bed 11. The caisson has a roof 12 with a circular opening 13. The circular opening is faced with a wear surface 14, for example made from rubber or timber, that transmits horizontal forces between the mooring buoy 15 and the caisson 10. The mooring buoy 15 contains a variable buoyancy chamber 16 that is used to regulate the buoyancy of the mooring buoy. The mooring buoy 15 moors the vessel 20 through the friction developed between the vessel 20 and the buoy 15.

When no vessel is moored at the buoy 15, the buoyancy chamber 16 is flooded and the buoy rests on the roof 12 of the caisson 10. When a vessel 20 to be moored is directly over the mooring buoy 15, compressed air from a storage tank 23 aboard the buoy is injected into the buoyancy chamber 16, and the buoy 15 rises in the water to contact the keel of the vessel 20. The vessel 20 is equipped with a pump 21 producing suction within an area on top of the buoy 15 bordered by the annular seal 17. The vessel can be equipped with any of the devices for producing suction described in U.S. Pat. Nos. 5,305,703 or 5,477,114, the disclosures of which are incorporated by reference. In consequence, the hydrostatic pressure above buoy 15 is reduced and the buoy 15 is pressed onto the hull of the vessel 20.

The vessel floats in an ice-infested sea with a surface 22. A salient feature of ice-infested waters is that waves are nearly non-existent. In consequence, very little vertical motion between the buoy 15 and the caisson 10 is caused by waves. Vertical motion from other causes such as tide level variation and loading condition can be controlled by the ballast water system all ships have; thus the vertical distance between the buoy 15 and the caisson 10 can be kept nearly constant and through design can be kept to a low value, such as a few meters. This may be important in order to limit the moment that tends to break the buoy 15 away from the hull of the vessel 20.

Although not shown, the roof 12 can be constructed below the sea bed 11 such that the top of the buoy 15 is also below the sea bed when no vessel is present. At locations with heavy ice this may be desirable to protect the buoy against direct contact with ice pressure ridges.

Figure 2:
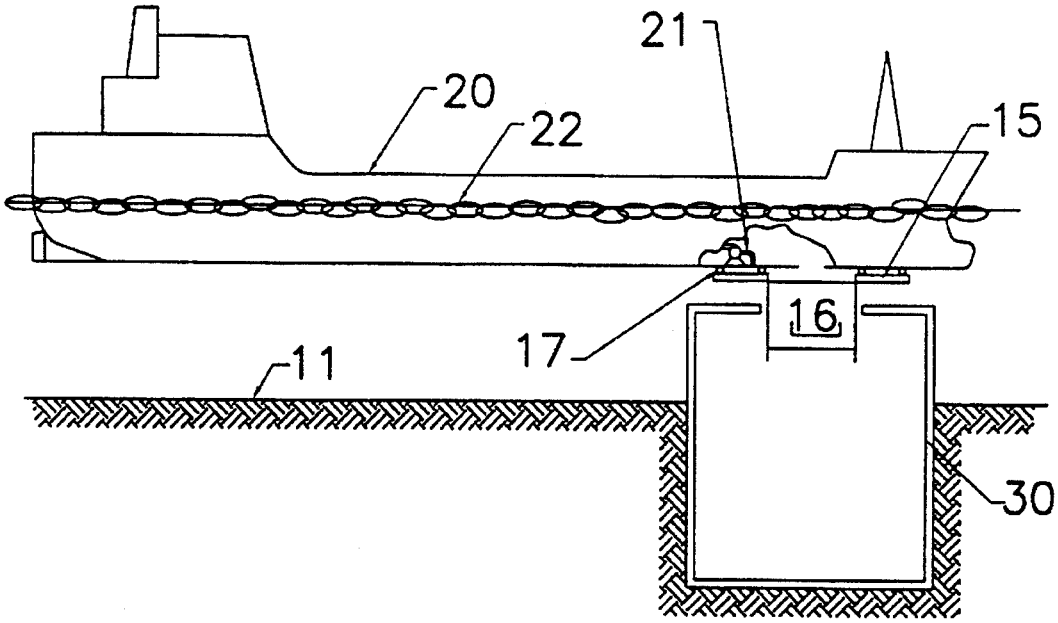
FIG. 2 shows a side view of a modification of the first embodiment of the present invention.

FIG. 2 shows an embodiment of the present invention virtually identical to the embodiment shown in FIG. 1. In this embodiment, the water depth is larger and therefore the caisson 30 protrudes above the sea bed 11 and the buoy 15 is attached to the caisson 30 a short distance below the draft of the vessel 20. In all other respects, this embodiment is identical to the embodiment shown in FIG. 1.

Figure 3:
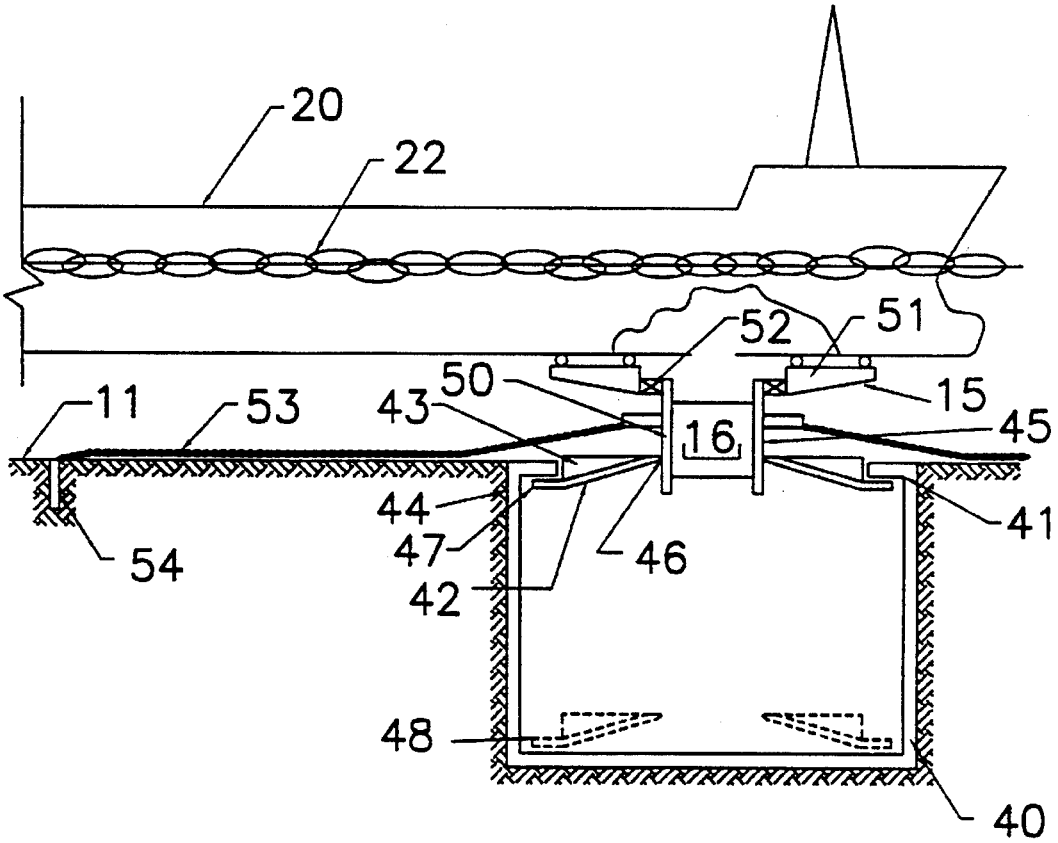
FIG. 3 shows a side view of a second embodiment of the present invention.

FIG. 3 shows an embodiment of the invention that is convertible to the type of mooring described in U.S. Pat. Nos. 5,305,703 and 5,477,114. In this embodiment the caisson 40 is not equipped with a fixed roof but with a lip 41 that prevents a buoyant roof 42 from floating out of the caisson 40. The buoyant roof 42 has variable flotation tanks 43 that can be dewatered by the application of pressurized air from a storage tank (not shown) in the roof 42. This system may for example be operated by divers. In the winter season when the sea surface 22 is ice covered the roof 42 is made buoyant and floats to the position 44. The roof 42 is designed with sufficient buoyancy that the moment generated by the horizontal mooring force cannot tilt the roof. The roof 42 engages a prismatic or cylindrical downward facing element 45 of the mooring buoy 15. The mooring forces are then transferred from the buoy 15 to the roof 42 through the contact surfaces 46. The force is then transferred from the roof 42 to the caisson 40 through the contact surfaces 47. A typical diameter of caisson 40 may be 100 m and a typical net buoyancy of the roof 42 in position 44 may be 100 MN.

The roof 42 is in the summer time or open water season ballasted and stored at the floor of caisson 40 in position 48, show in dashed lines.

The buoy 15 is comprised of two parts 51 and 50 separated by a bearing 52. The part 50 remains rotationally fixed with respect to the sea bed 11 by radial mooring lines 53 anchored to the sea bed at anchors 54. The part 51 remains rotationally fixed to the vessel and the bearing 52 permits the vessel 20 to weather vane with respect to the sea bed 11. The buoy 15 can be raised or lowered by the variable buoyancy chamber 16.

In open water season, the vessel is moored by the buoy 15, which in turn is anchored by the mooring lines 53. This configuration permits large horizontal and vertical excursions of the buoy 15, thereby securely anchoring the vessel against the actions of the waves, wind, and current. In the winter or ice season the roof 42 is raised to position 44, into engagement with the buoy 15, thereby causing the buoy 15 to be able to withstand the much larger winter time horizontal mooring forces.

Figure 4:
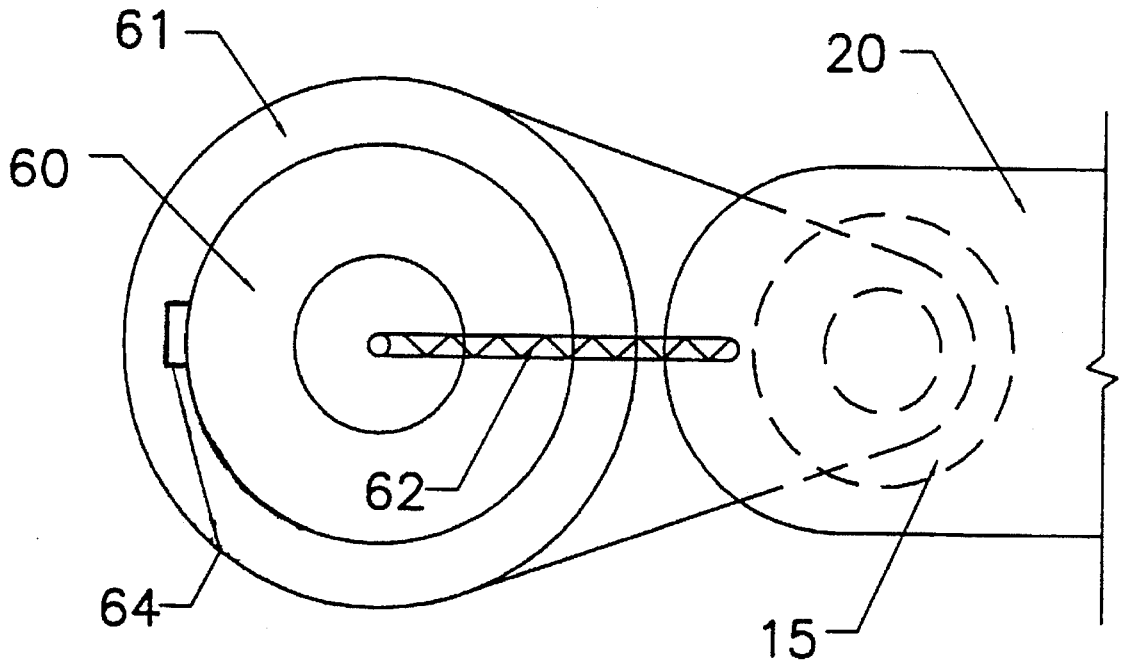
FIG. 4 shows a top view of a third embodiment of the present invention.

FIG. 4 shows in top view another embodiment of the present invention in which the vessel 20 is moored to a submerged buoy 15 as in the previous embodiments. The buoy 15 is slidably engaged to an arm 61 which is rotatably connected to the anchor structure 60, which in turn is structurally connected to the sea bed. This embodiment includes an above-water rotatable arm 62 which can serve to support fluid connectors and other cargo transfer equipment permitting the transfer of cargo between the vessel 20 and the anchor structure 61.

Figure 5:
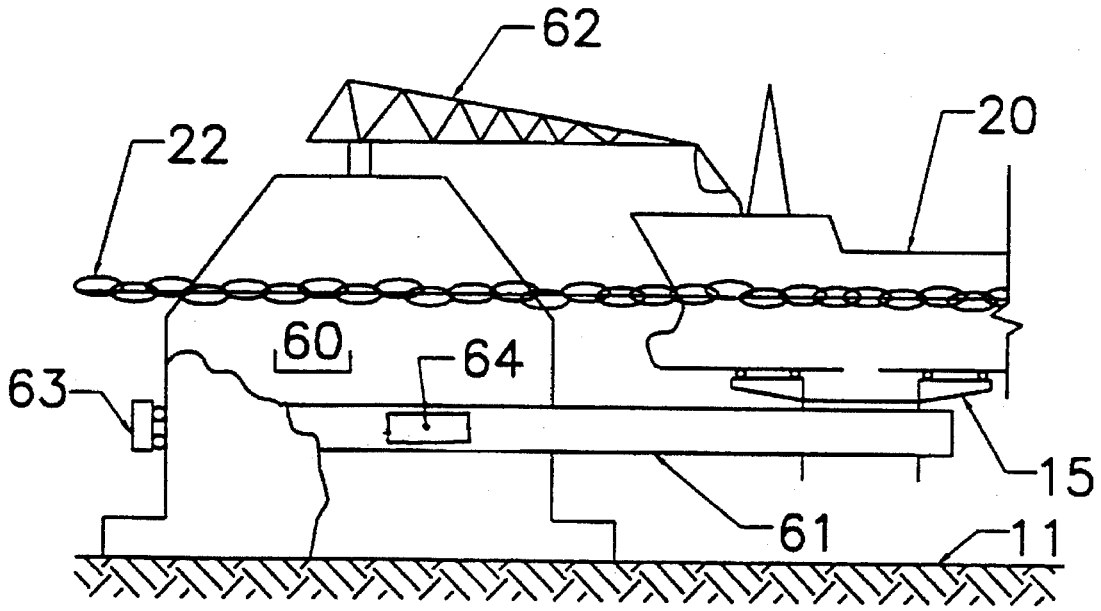
FIG. 5 shows a side view of the embodiment of FIG. 4.

FIG. 5 shows the embodiment of the present invention shown in FIG. 4 in a side view. The buoy 15 can slide vertically with respect to the arm 61, which in turn is supported rotatably on the anchor structure 60 though the bearing 63. One of the advantages of this embodiment is that the anchor structure 60 protrudes above the water through the ice field. In drifting ice the anchor structure 60 would cause a lead or ice break to be formed in the ice in which the vessel 20 is moored. The lead causes a reduction in the mooring forces transmitted to the anchor structure 60 via the buoy 15 and the arm 61. A disadvantage of this embodiment is that the arm 61 does not automatically align itself with the lead, therefore when the vessel 20 is approaching it may be necessary to move the arm 61 into alignment with the approaching vessel by applying power to the arm. Such movement may for example be effected through indexing hydraulic cylinders (64) within the bearing 63.

Figure 6:
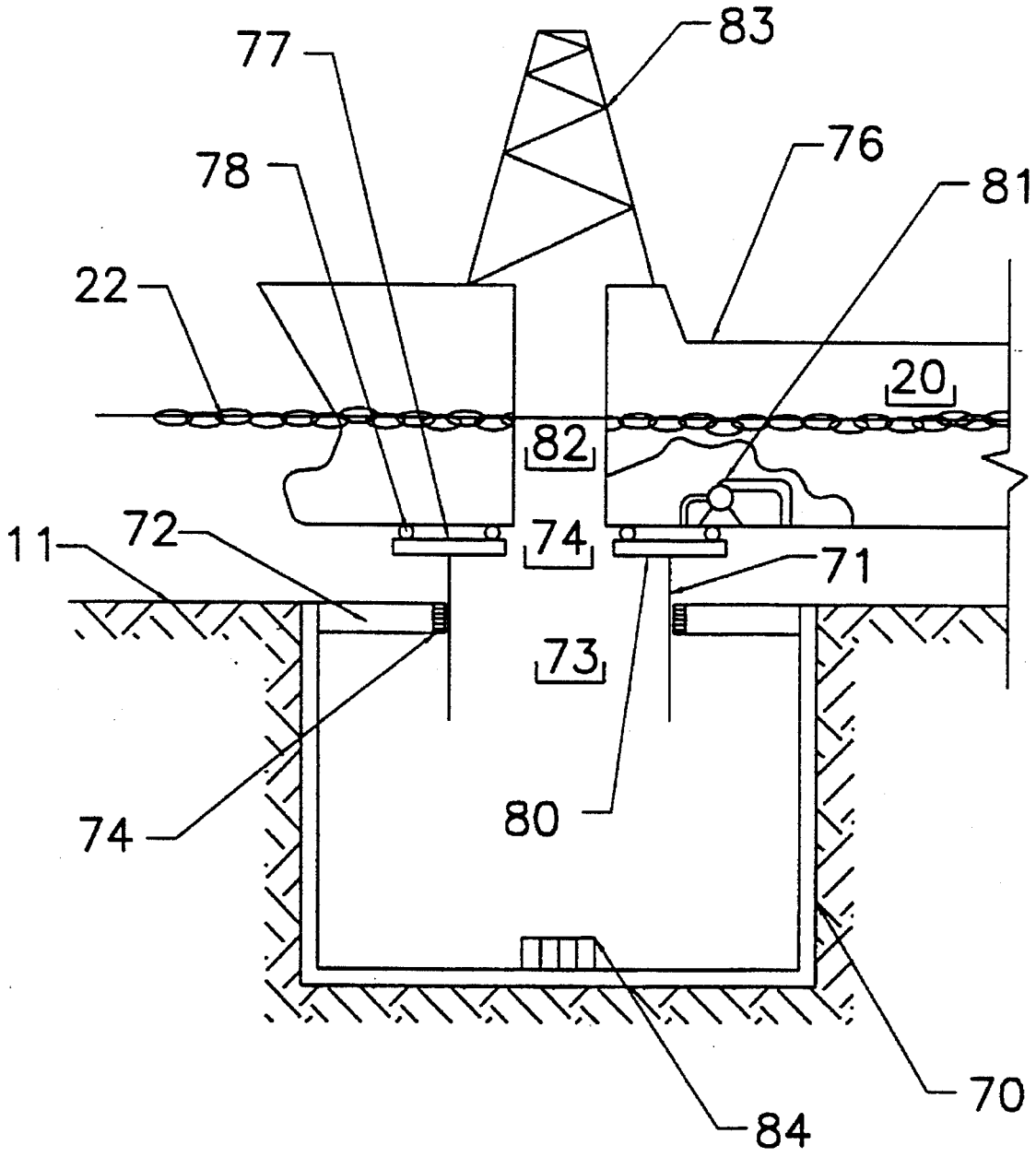
FIG. 6 shows a side view of a fourth embodiment of the present invention.

FIG. 6 shows yet another embodiment of the present invention which is particularly applicable to drilling vessels, but can also be used with production and shuttle vessels. The anchor structure is a circular caisson 70 of size sufficient to resist the mooring forces. The caisson 70 is sunk into the sea bed 11. The caisson has a roof 72 with a circular opening 73. The circular opening is faced with a wear surface 74, for example made from rubber or timber, that transmits horizontal forces between the mooring buoy 71 and the caisson. 70. The mooring buoy has a large diameter opening in the center which permits operations to be performed within the caisson 70 from the deck 76 of the vessel 20. The mooring buoy has a flat annular surface 77 bordered by seals which are engageable to the mooring area. The mooring buoy 71 contains variable buoyancy chambers 80 that are used to regulate the buoyancy of the mooring buoy 71. The mooring buoy 71 moors the vessel 20 through the friction developed between the vessel 20 and the buoy 71.

When no vessel is moored at the buoy 71 the buoyancy chambers 80 are flooded and the buoy rests on the roof 72 of the caisson 70. When a vessel 20 to be moored is directly over the mooring buoy 71, compressed air from a storage tank aboard the buoy (not shown) is injected into the buoyancy chambers 80 and the buoy 71 rises in the water to contact the keel of the vessel 20. The vessel 20 is equipped with a pump 81 taking suction within an area on top of the buoy 71 bordered by the annular seals 78. In consequence the hydrostatic pressure above buoy 71 is reduced and the buoy 71 is pressed onto the hull of the vessel 20. The vessel may be equipped with a shaft 82 permitting a drill rig 83 to perform operations on a well head 84 within the caisson 70. This arrangement is particularly advantageous because the well head is completely protected from the floating ice by the caisson 70 and the roof 72 even when the vessel 20 is not present.

Figure 7:
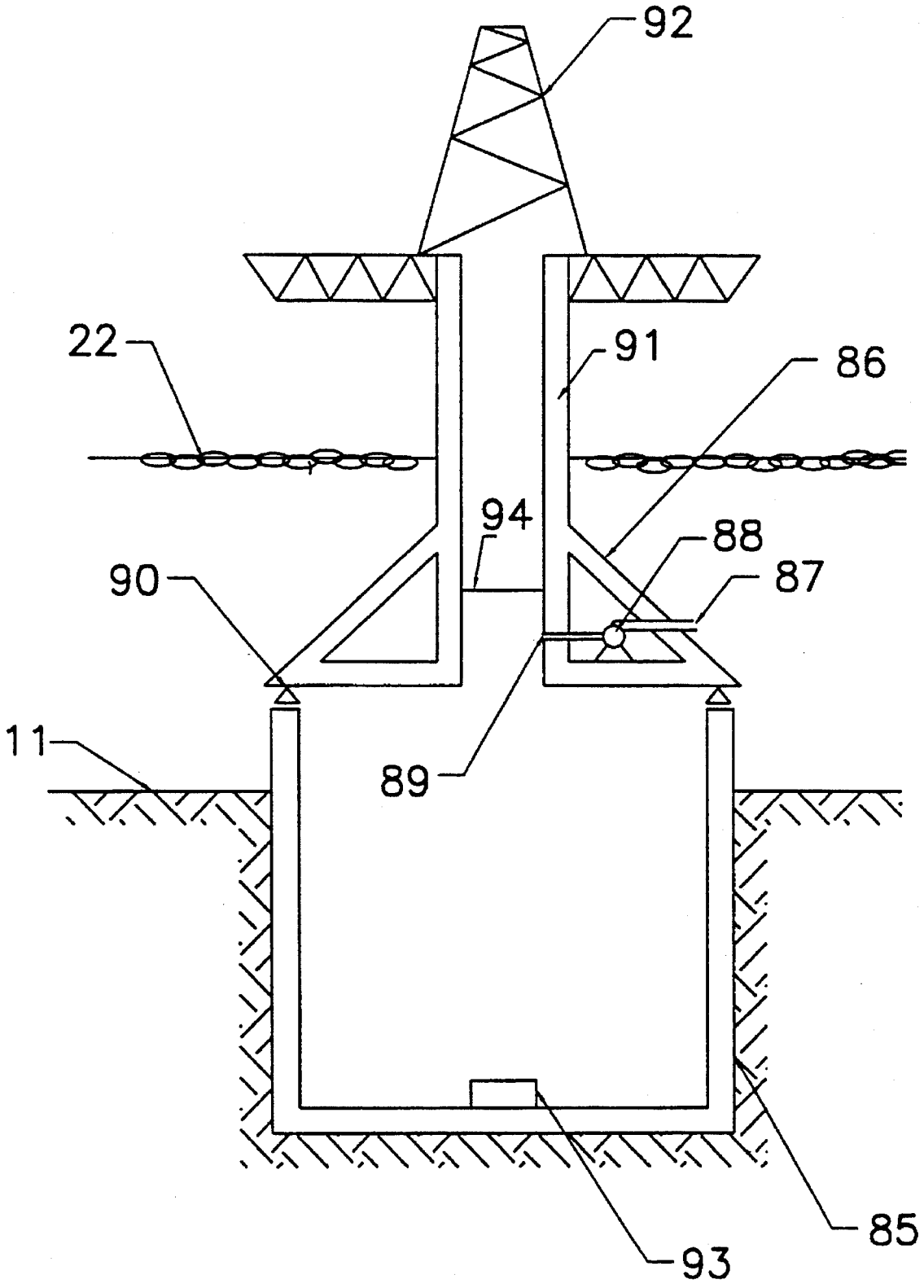
FIG. 7 shows a side view of a fifth embodiment of the present invention.

FIG. 7 shows a further embodiment of the present invention, which is particularly suited for vessels that are either rotationally symmetrical about a vertical axis or for which the length and the width are nearly the same. The vessel 91 is shown sitting on top of an anchor structure 85 which is structurally fixed to the sea bed 11. The vessel 91 may be brought over the anchor structure 85 by tug boats (not shown) or by built-in propulsion (not shown). Once the vessel 91 is in position above the mooring structure 85 the vessel 91 has its draft increased by ballasting. While ballasting, the pump 88 creates suction at the keel of the vessel 91, through intake 89. The water pumped by pump 88 is discharged outside the vessel 91 at discharge 87. When the vessel 91 contacts the circumferential sealing element 90 (which sealing element 90 may also be on the vessel and contact the mooring structure 85), the water pressure below the vessel is lowered, as illustrated by the interior water level 94. As a result, the vessel 91 is forced down onto the mooring structure 85 with a very large force caused by hydrostatic pressure. Large horizontal mooring forces of the same magnitude may be resisted by the friction between the vessel 91 and the mooring structure 85. A particularly advantageous shape of the vessel 91 for ice conditions in the Arctic is illustrated in FIG. 7. The vessel 91 is equipped with a conical surface 86 which promotes breaking of ice impinging on the vessel 91, and is substantially rotationally symmetrical about a vertical axis to ensure that ice may be broken no matter what direction it flows. The vessel 91 may, for example, be equipped with a drilling rig 92 to service a sub-sea well head 93.

Figure 8:
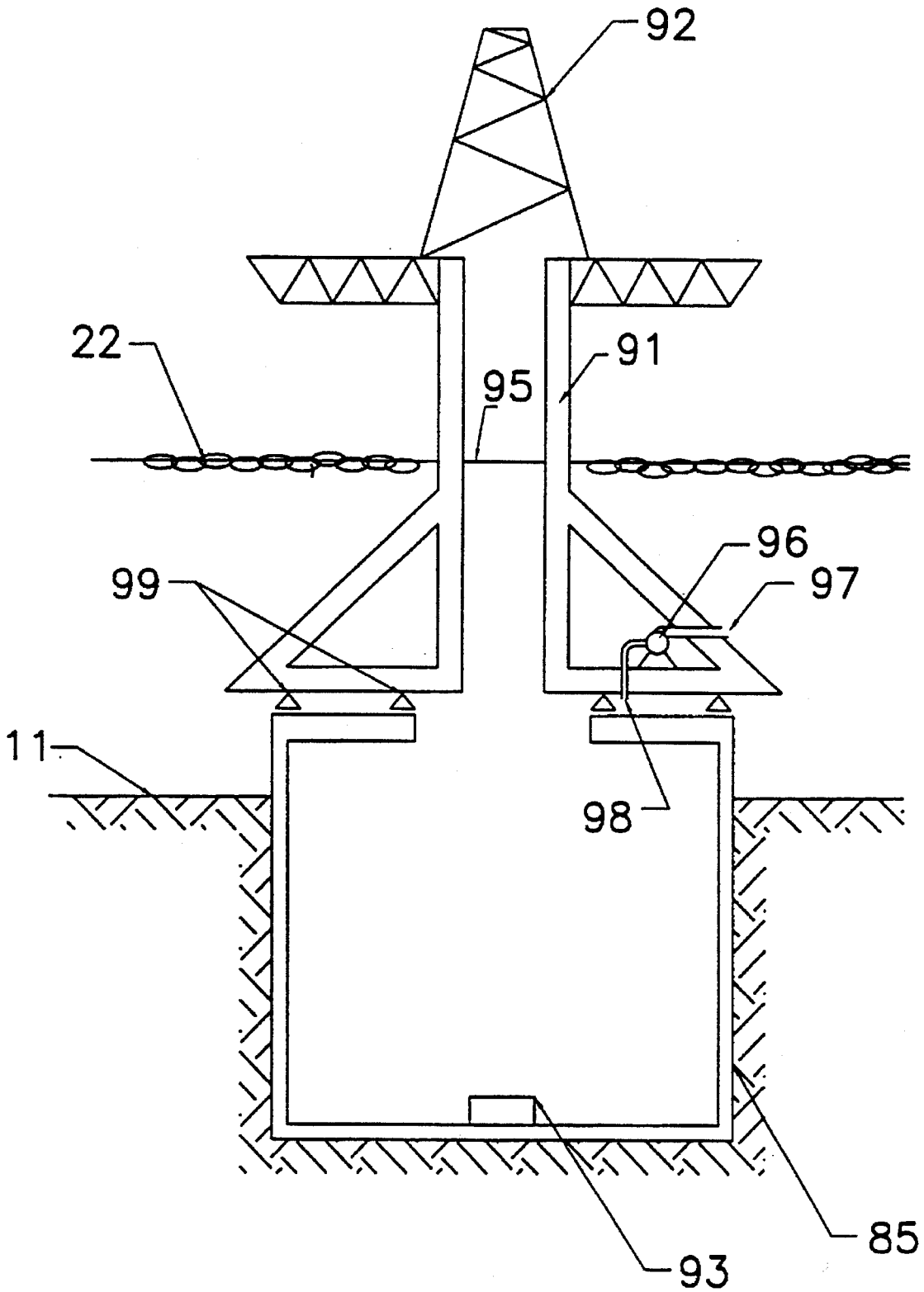
FIG. 8 shows a side view of a sixth embodiment of the present invention.

FIG. 8 shows another embodiment of the invention substantially similar to the embodiment of FIG. 7. In the embodiment of FIG. 8, the vessel 91 is brought into position and ballasted in the same manner as for the embodiment of FIG. 7. The vessel 91 is fitted with a pump 96 that has an intake 98 at the keel and a discharge 97 on the side of the vessel. When the vessel 91 is in position for mooring, the intake is vertically above an area of the roof of the mooring structure 85 that is bordered by seals 99 that are radially inside and radially outside, respectively, the pump intake 98.

The pressure in the volume defined by the lower end of the vessel 91, the upper end of the mooring structure 85 and the seals 99 is lowered by the pump 96. Depending on the selection of a suitable pump 96, the pressure may be lowered as far as the vapor pressure of sea water. If the diameters of the seals 99 are 100 m and 50 m respectively, and the draft of the vessel 91 is 30 m, the resulting attractive force between the vessel 91 and the mooring structure 85 is $(\pi/4)*(100^2-50^2)*400$ kN=2300 MN. A friction coefficient of 0.3 between the vessel 91 and the anchor structure 85 will allow a horizontal force of 690 MN to be resisted. This mooring force would typically be sufficient for even the highest ice or wave forces that the structure could be subjected to in the ocean, thereby mooring the structure securely.

What is claimed:

1. An ocean mooring system comprising:

a vessel comprising a hull and an annular mooring area in a bottom of said hull;

a buoyant mooring element having an upper part that is engageable with said mooring area;

an anchoring structure vertically slidably engaged with a lower part of said mooring element and which is structurally fixed to a sea bed;

means for lowering a hydrostatic pressure in said mooring area, thereby forcing said mooring element onto said mooring area; and means for regulating a buoyancy of said mooring element, to raise said mooring element into contact with said hull and to lower said mooring element away from contact with said hull.

2. The ocean mooring system according to claim 1, wherein:

said means for lowering a hydrostatic pressure comprises a water intake in said hull within said mooring area, said water intake having sufficient flow capacity to remove water leaking past said mooring element into said mooring area.

3. The ocean mooring system according to claim 2, wherein:

said mooring element comprises two or more resilient annular members, said resilient annular members making sealing contact at locations in said mooring area, at least one of said resilient annular members being radially outside said water intake and at least one of said resilient annular members being radially inside said water intake.

4. The ocean mooring system according to claim 2, wherein:

said mooring element comprises a resilient annular member, said resilient annular member making sealing contact at a location in said mooring area, said resilient annular member being radially outside said water intake.

5. The ocean mooring system according to claim 1, wherein:

said mooring element comprises of two parts separated by a bearing, said bearing allowing said two parts to rotate relative to one another.

6. The ocean mooring system according to claim 1, wherein:

said anchoring structure comprises two parts, a first of said parts being in structural contact with said sea bed and a second of said parts being movable with respect to said first part, said second part being movable from a first position to a second position, said first position of said second part engaging said mooring element to create said slidable engagement, said second position of said second part disengaging said second part from said mooring element.

7. The ocean mooring system according to claim 6, wherein:

said mooring element is anchored to said sea bed with radially deployed anchor lines.

8. The ocean mooring system according to claim 6, wherein:

said second part is movable by ballasting and deballasting said second part with a compressed gas.

9. The ocean mooring system according to claim 1, wherein:

said means for regulating a buoyancy is a source of compressed gas for ballasting and deballasting said mooring element.

10. An ocean mooring system comprising:

a vessel comprising a hull and an annular mooring area in a bottom of said hull;

a buoyant mooring element having an upper part that is engageable with said mooring area;

an anchoring structure comprising two parts that can rotate about a vertical axis relative to one another, a first of said parts being structurally connected to a sea bed and a second of said parts being rotatably connected to said first part and vertically slidably connected to a lower part of said mooring element;

means for lowering a hydrostatic pressure in said mooring area, thereby forcing said mooring element onto said mooring area; and means for regulating a buoyancy of said mooring element, to raise said mooring element into contact with said hull and to lower said mooring element away from contact with said hull.

11. The ocean mooring system according to claim 10, wherein:

said two parts of said anchoring structure can be rotated mechanically relative to one another, thereby to position said mooring element in a proper heading for mooring said vessel.

12. An ocean mooring system comprising:

a vessel comprising a hull and an annular mooring area in a bottom of said hull;

a buoyant mooring element having an upper part that is engageable with said mooring area;

an anchoring structure slidably engaged with a lower part of said mooring element and which is structurally fixed to a sea bed, said anchoring structure comprising two parts, a first of said parts being in structural contact with said sea bed and a second of said parts being movable from a first position to a second position, said first position of said second part engaging said mooring element to create said slidable engagement, said second position of said second part disengaging said second part from said mooring element;

means for lowering a hydrostatic pressure in said mooring area, thereby forcing said mooring element onto said mooring area; and means for regulating a buoyancy of said mooring element, to raise said mooring element into contact with said hull and to lower said mooring element away from contact with said hull.

13. The ocean mooring system according to claim 12, wherein:

said mooring element is anchored to said sea bed with radially deployed anchor lines.

14. The ocean mooring system according to claim 12, wherein:

said second part is movable by ballasting and deballasting said second part with a compressed gas.

* * * * *